US007175163B2

(12) United States Patent
Blanc

(10) Patent No.: US 7,175,163 B2
(45) Date of Patent: Feb. 13, 2007

(54) CAPSTAN WINCH

(75) Inventor: M. Remi Blanc, Rueil Malmaison Cedex (FR)

(73) Assignee: Kley France, Rueil-Malmaison (FR)

( * ) Notice: Subject to any disclaimer, the term of this patent is extended or adjusted under 35 U.S.C. 154(b) by 0 days.

(21) Appl. No.: 10/525,663

(22) PCT Filed: Aug. 26, 2003

(86) PCT No.: PCT/FR03/50040

§ 371 (c)(1),
(2), (4) Date: Jul. 22, 2005

(87) PCT Pub. No.: WO2004/020323

PCT Pub. Date: Mar. 11, 2004

(65) Prior Publication Data

US 2006/0022182 A1 Feb. 2, 2006

(30) Foreign Application Priority Data

Aug. 28, 2002 (FR) ..... 02 10649

(51) Int. Cl.
*B66D 1/23* (2006.01)

(52) U.S. Cl. ..... 254/278; 254/293

(58) Field of Classification Search ..... 254/278, 254/293, 371

See application file for complete search history.

(56) References Cited

U.S. PATENT DOCUMENTS 3,692,280 A * 9/1972 Eastcott et al. ..... 254/371
3,843,096 A 10/1974 Wilson
3,934,482 A * 1/1976 Byers ..... 474/9
3,966,170 A 6/1976 McKenna
5,792,294 A * 8/1998 Randazzo et al. ..... 156/94
6,364,061 B2 * 4/2002 Baranda et al. ..... 187/254
6,386,324 B1 * 5/2002 Baranda et al. ..... 187/254
6,390,242 B1 * 5/2002 Baranda et al. ..... 187/254

FOREIGN PATENT DOCUMENTS

DE 47 478 C 10/1968
FR 1 105 165 A 11/1955
FR 1 394 141 A 4/1965
FR 2 669 701 A 5/1992
WO WO-00/10903 A 3/2000

* cited by examiner

*Primary Examiner*—Emmanuel M Marcelo
(74) *Attorney, Agent, or Firm*—Fulbright & Jaworski LLP

(57) ABSTRACT

The invention concerns a so-called capstan winch (1) comprising drums (2, 3) driving a cable (C) and provided with a peripheral wall (22, 32) around which are strung independent peripheral rings (40–45, 50–55). Said rings are provided with a peripheral groove designed to receive the cable (C) and are made of an elastic material so as to allow both the cable (C) to be driven and a relative sliding movement between the peripheral rings (40–45, 50–55) and the peripheral wall (22, 32), the relative sliding movement being of amplitude substantially equal to longitudinal deformation of the cable (C), when it is subjected to tension stresses. The two drums (2, 3) can be axially offset relative to each other (p/2) and their axes of rotation ($\Delta_1$, $\Delta_2$), may form a non-null angle of inclination. The invention is particular applicable to deep sea oil exploration.

9 Claims, 3 Drawing Sheets

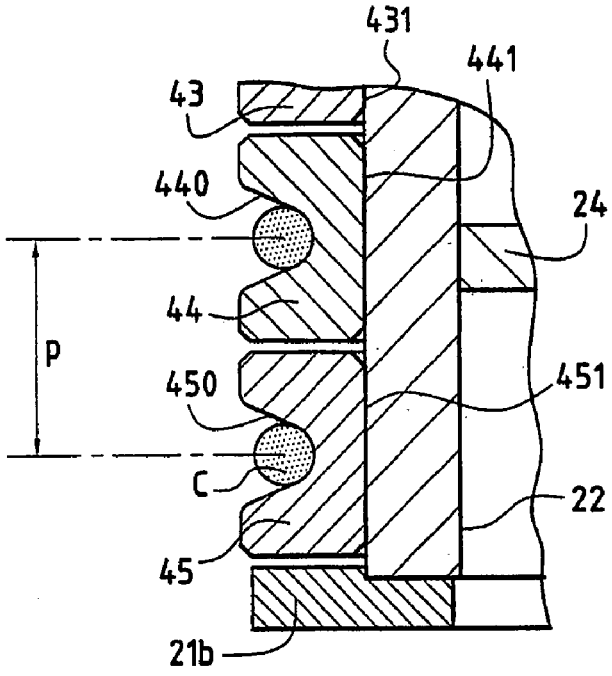
FIG.2
FIG.3
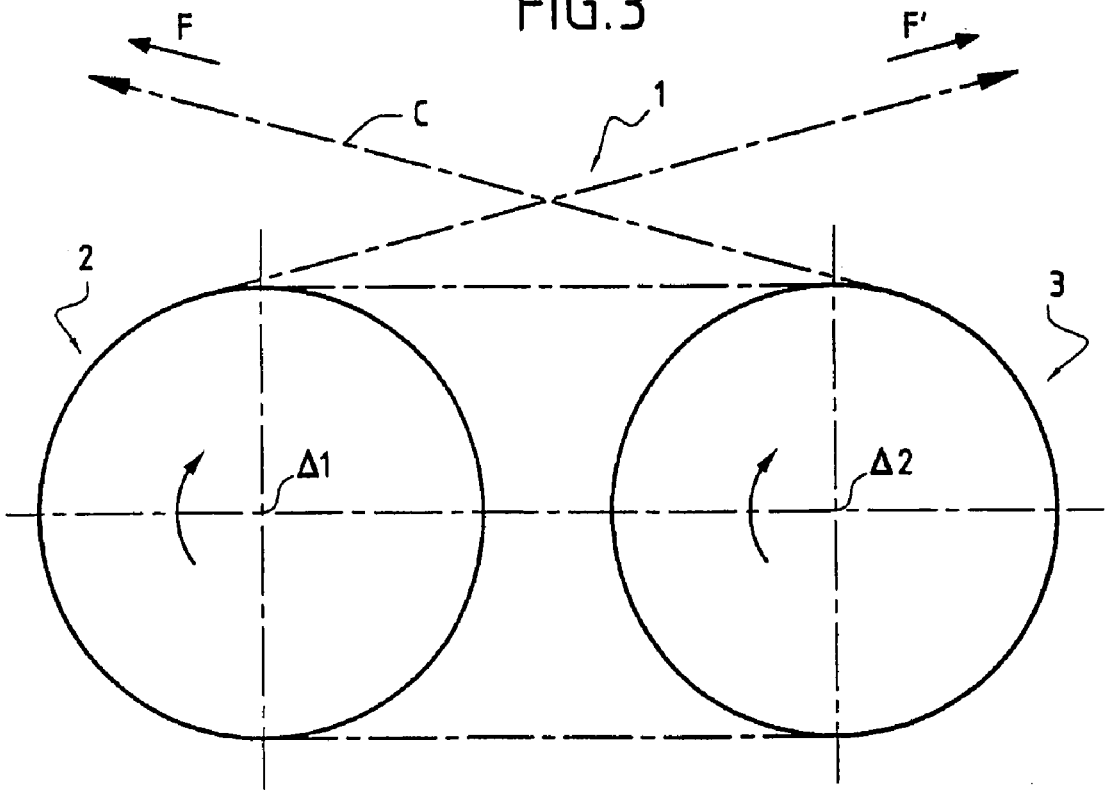

CAPSTAN WINCH

This application is a §371 from PCT/FR03/050040 filed Aug. 26, 2003, which claims priority from FR 02/10649 filed Aug. 28, 2002, each herein incorporated by reference in its entirety.

FIELD OF THE INVENTION

The invention concerns a winch of the so-called capstan type, particularly one having two drums.

It applies more particularly to a winch intended to haul very heavy loads by means of a cable, a not inconsiderable part of the said load being then often constituted by the weight of the cable, generally a cable of large diameter and of very great length once unwound.

The invention also concerns the application of such a winch to technologies of the type called "off-shore," generally in petroleum exploration industries or the like, to oceanography and to dredging at great depths, etc.

In the scope of the invention, the term "winch" is to be understood in its most general sense.

To be concrete, we will be dealing hereinafter with the preferred application of the invention, which is to petroleum exploration requiring the lowering and/or raising of loads to and from great depths.

BACKGROUND OF THE INVENTION

Capstan winches of the single drum and double drum types have long existed, but they suffer from the problem of causing the very rapid wear of the cable being manipulated. This is due to their very principle of operation. The cable is driven by adherence. As the tension that is applied to the cable increases, the cable stretches and its linear speed increases accordingly. Since the driving grooves with which the winch drums are equipped are totally rigid, the result is relative slippage between the cables and the grooves.

In the attempt to relieve these problems many modifications have been proposed in the prior art. Improvements have been contributed to this type of winch in order to limit slippage, but they have not entirely eliminating it.

Many types of winches exist. Particularly the drum winches referred to above, of the capstan type or of the type called "traction winches" according to Anglo-Saxon terminology, and the multi-pulley type.

In French Patent No. 90 14 612, published under the number FR 2 669 701 B1, entitled, "Poulie d'adhérence," the applicant has proposed a pulley permitting a traction force to be applied to a cable. The pulley comprises a wheel and an endless belt wound on the peripheral surface of the wheel to support the cable to be driven. The endless belt is made up of a succession of shoes spaced apart which can slide with friction on the wheel, each shoe being connected to the next by an elastically stretchable connector whose longitudinal modulus of elasticity and/or dimensions are chosen such that, in service, the elongation of the endless belt corresponds to that of the cable under a predetermined maximum tension.

For a more detailed description of the characteristics of this device it will be beneficial to consult the above-mentioned patent.

These arrangements make it possible to eliminate virtually all slippage. Shoes embodying the technology taught by the patent have since then been made and used. They completely respond to the purposes which were the aim of the above patent, at least for a well-defined range of applications.

In fact, the technology employed does not permit the manufacture of winches capable of lifting loads exceeding 50 tonnes (about 490 kN). Moreover, this type of winch is very sensitive and somewhat unstable in use. Lastly, great heat can develop in certain circumstances due to the slippage of the endless belt, especially on the edges of the drum.

Nowadays the oil exploration industries, in particular, need winches capable of dragging very heavy loads, typically equal to or greater than 200 T (about 1960 kN), and this in very deep waters (2000 m to 3000 m, even 10000 m for certain applications). Only synthetic cables (whose apparent weight in water is very low, even zero) can be used for this type of application. However, these cables are very expensive, which excludes the use of classical winches. Indeed, as stated above, winches of this type would wear them out too fast.

Lastly, some cables have a complex structure. In fact, in addition to their classical applications, cables are sometimes employed in related applications: energy transport, for example electrical energy (electric carrier cables), or the transmission of analog signals or digital data, for example internal optical fibers (cables known as optical carriers). It can be understood that this type of cable is particularly expensive and that premature wear is economically unacceptable.

SUMMARY AND OBJECTS OF THE INVENTION

The invention aims to relieve the problems of the devices of the prior art, some of which have just been recalled, while answering the needs that are making themselves felt, particularly in the scope of the preferred application of the invention.

The invention is aimed at a winch making it possible particularly to lift great loads by means of a cable, while substantially eliminating the slippage due to the stretching of the cable lifting these loads, and making it possible to avoid premature wear.

To do this, according to a first important feature, the winch of the invention employs a pulling technique, known in itself, of the two-drum capstan type. This is a reliable technique, and recognized as such, which enables one to profit from its advantages.

According to a second important feature, a series of independent closed rings is employed, made of material with an elastic property, concentric to the two drums. This arrangement makes it possible to retain the advantages inherent in the device covered by French Patent No. 90 14 612, referred to above, viz., to be able to prevent the relative slippage between the throat and the cable, while still avoiding the problems referred to.

The rings mentioned above are equipped with throats machined on the periphery in which the cable to be driven is inserted.

The material constituting the rings must have physico-chemical characteristics enabling it to withstand the loads and the pressures applied, for a given application, as well as to change shape to elongate by the same amount as the cable in the same conditions.

Furthermore, the friction characteristics must be such that they permit driving the cable by the drum in all safety. Therefore there is no relative movement between the cable and the throats of the rings. On the contrary, the body of the ring must be able to slip on the drum (very small relative movement due to the elongation).

In one preferred embodiment of the invention, in order to minimize the friction of the cable on the throats, the rings are advantageously offset axially by a fraction of a step, advantageously a fraction of a step, the step being defined by the distance separating the bottom of the throats of two adjacent rings on the same drum.

In another preferred embodiment, the axes of the two drums can be non-parallel in order to limit the friction still more. In other words, the axes form between themselves an angle of little amplitude, typically between 0.5° and 3°.

Lastly, although in one preferred embodiment, the number of drums is equal to two, it is possible to conceive of winches comprising a greater number of drums without departing from the scope of the invention.

Due to the arrangements adopted, the invention offers many advantages, among which are the following:

- it is possible to operate with any type of cables: steel, synthetic, normal, electricity carrying or video carrying, etc.;
- it is possible to resort to very great winding diameters;
- no relative slippage, as it has been mentioned, between the cable and the throat of the rings, or at least none of appreciable amplitude;
- the rings undergo but an infinitesimal circumferential movement on the drum, but no axial movement, contrary to a belt winch according to French patent No. 90 14 612 referred to above; this feature allows the heating of the belt to be considerably limited, as well as its already very limited wear;
- likewise, the absence of axial movement permits the suppression of the deflection wheels which used to be necessary in the case of a band winch, fragile and troublesome rollers;
- the near absence of heating also permits dispensing with any drum cooling systems;
- the use of a winch according to the invention is very simple, sure and reliable, and does not require the permanent presence of specialist personnel;
- the rings are easy to produce and machine; and
- they are easily interchangeable, making it possible to change the cable used (in diameter and/or type) without major modifications of the winch proper.

The invention therefore has as its principal object a winch of the type called capstan winch, comprising at least two drums arranged opposite one another, pulling a load by means of a cable wound on the said drums in a predetermined number of turns, characterized in that each of said drums comprises a peripheral wall and is equipped with a predetermined number of peripheral rings of elastic material, independent of one another, wound around the said peripheral wall, in that the said peripheral rings are provided each with a peripheral throat designed to receive the said cable, and in that the elastic material constituting the said peripheral rings is provided with physico-chemical characteristics such that it permits, both at once, a driving of the said cable and a relative slippage between one inside wall of said peripheral rings in contact with the said peripheral wall of the drums and this wall, the said relative slippage being of an amplitude substantially equal to the longitudinal deformations undergone by the said cable when it is subjected to tensions of variable amplitude.

The invention has also as its object the application of such a winch to petroleum prospecting or water prospecting for the lowering and/or retrieving of large loads.

BRIEF DESCRIPTION OF THE DRAWINGS

The invention shall now be described in greater detail, referring to the annexed drawings, of which

FIG. 2 is a detail view of the winch of FIG. 1, showing more particularly the independent rings of elastic material, provided with peripheral grooves intended to receive a cable;

FIG. 3 schematically shows the operation of the winch of FIGS. 1 and 2.

DESCRIPTION OF THE EMBODIMENTS

Without in any way limiting the scope, what follows relates to the preferred application of the invention, that is to say, to the case of so-called "off-shore" applications: petroleum prospecting or the like, involving the lowering and/or retrieval of loads at great depths by means of a cable.

An example of a first preferred embodiment of a winch according to the invention will be described with reference to FIGS. 1 to 3.

In these figures, identical elements bear the same numbers and will be redescribed only when necessary.

Figure 1:
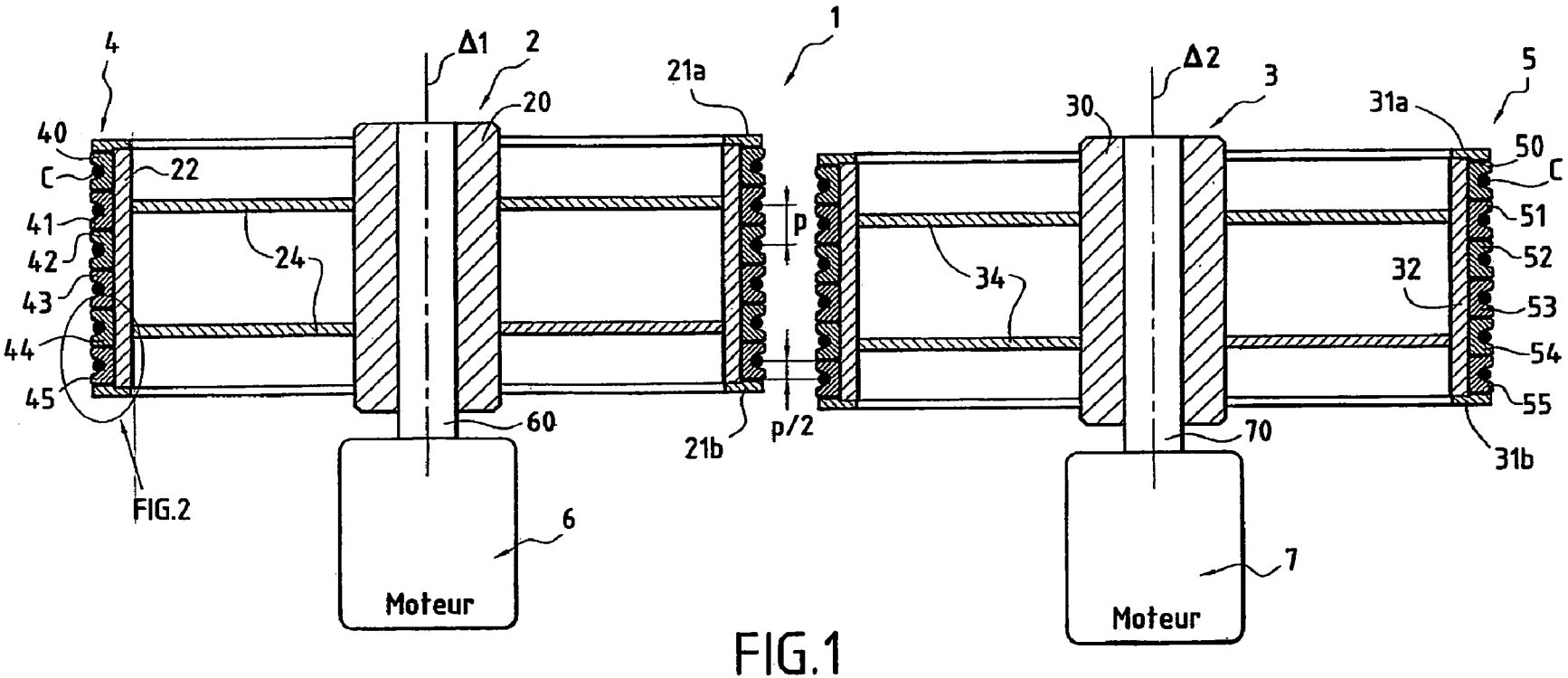
FIG. 1 shows schematically an embodiment of a winch according to a first preferred embodiment of th invention, in a top view and in partial section.

FIG. 1 schematically illustrates the winch 1, in a top plan view and in partial section. This winch 1 comprises two sub-assemblies, each comprising essentially one driving motor 6 and 7, respectively, and one drum driving a cable C, 2 and 3, respectively.

This assembly therefore shows the general structure, known in itself, of a so-called "bi-capstan" winch. It also retains the advantages, also well known, as it has been recalled.

The drums 2 and 3 are equipped with central rotatory shafts 20 and 30, respectively, on axes of rotation $\Delta_1$ and $\Delta_2$. In the example described, the shafts 20 and 30 are hollow and concentric with drive shafts 60 and 70 driven by their respective motors 6 and 7.

It must be clear that, in a practical embodiment, step-down means of the gear, a speed-box or the like, can be advantageously provided. This aspect departs from the strict scope of the invention and is in reach of the man of the art. These are arrangements common in themselves to the known art. It is therefore useless to describe them hereinafter.

The drums 2 and 3 comprise a cylindrical peripheral wall, 22 and 32, respectively, sustained by at least two central radial parts (two per drum in the example described), 24 and 34, respectively.

Pairs of lateral rings, 21*a*–21*b* and 31*a*–31*b*, are arranged on either side of the peripheral walls 22 and 32.

Each of the peripheral walls 22 and 32 forms with the pair of lateral rings associated with it, 21*a*–21*b* and 31*a*–31*b*, respectively, a groove to be called hereinafter a "drum groove."

According to an important feature of the invention, a series of independent peripheral rings, 40–45 and 50–55, respectively, are slipped over the peripheral walls 22 and 32 into the previously mentioned drum grooves. These rings are made of elastic material, for example a synthetic material.

As the detail FIG. 2 shows more particularly, the lower walls, 431 to 451, for example, of the peripheral rings 43 to 45 are substantially flat, so as to be in intimate contact with the peripheral walls 22 and 32 (FIG. 1) of the drums 2 and 3.

The peripheral rings 40–45 and 50–55 (FIG. 1) are provided with grooves likewise machined on the periphery, of which two are visible in FIG. 2: 440 and 450, for the respective rings 44 and 45. These grooves, 440 and 450, advantageously having the shape of a V rounded at the bottom, are designed to receive the drive cable C. The dimensions (depth, width, bottom radius, etc.) are of course adapted to receive one type of cable, or even a range of different cables.

It is easily understood that the installation (insertion or placement) of peripheral rings 40–45 and 50–55, or their replacement with identical rings or with different rings (for example, to accept a cable or different type and/or different diameter as well) is easy. It is only necessary that the pairs of lateral rings 21*a*–21*b* and 31*a*–31*b* (at least one of the rings of each pair) are removable, i.e., dismountable. It then suffices to thread the peripheral rings 40–45 and 50–55 onto the drums 2 and 3 around the cylindrical walls 22 and 32 and to remount the lateral rings 21*a*–21*b* and 31*a*–31*b*.

The lateral rings 21*a*–21*b* and 31*a*–31*b* can be fastened to the lateral walls by any appropriate means: screws, etc.

Basically, the number of rings 40–45 and 50–55 can be any number; it depends only on the number of turns (spirals) desired for the cable C around the drums 2 and 3. It is this number of turns that will constitute the determining factor of the demultiplication of force obtained, in conformity with the well-known principle of operation of a capstan. To be concrete, and by way of example, a number of peripheral rings between five and seven, or even more, is typically chosen.

FIG. 3 illustrates schematically the operation of a winch 1 according to the embodiment illustrated by FIGS. 1 and 2. The cable C is wound into the grooves (440 and 450, FIG. 2) of the peripheral rings 40–45 and 50–55, so as to form a plurality of loops or spirals around the drums 2 and 3. To explain, due to the demultiplication obtained by this arrangement, the output tension force F can be, for example 9 T (about 88 kN) for an input tension force F of 3 kN.

Coming in, the cable C is wound/unwound onto or from a storage place (not represented). This can be chosen from among those used commonly in the state of the art and there is no need to describe it henceforth.

Always, according to one of the important features of the invention, the material constituting the peripheral rings, 40–45 and 50–55, must be able, as it was recalled in the introduction of the present description, to withstand the loads and pressures exerted, to change shape so as to elongate at the same time as cable C. Furthermore, it must have frictional characteristics permitting cable C to be driven in complete safety by friction (adherence).

Therefore there are requirements that are contradictory but which can be satisfied by a compromise, particularly by an appropriate choice of the constitutive material of the peripheral rings 40–45 and 50–55, and that of the peripheral walls 22 and 32 of drums 2 and 3.

To be concrete, a synthetic material of the polyurethane, polyethylene or other type may be chosen for the rings.

Likewise, the peripheral walls 22 and 32, and drums 2 and 3, can be made particularly of stainless steel or ceramic-coated steel so as to assure the adherence [friction] mentioned above.

The cable C—and this is an additional advantage—can be of any type as stated in the introduction of the present description: steel cable, synthetic material cable, cable for carrying electricity or video, etc., even of the costly type. In fact, premature wear is no longer to be feared.

In the preferred embodiment, as illustrated in FIGS. 1 and 2, according to one advantageous feature, an axial offset can be provided, i.e., in a direction parallel to the shafts $\Delta_1$ and $\Delta_2$, parallel to one another, as it has been implicitly assumed up to this point in the description.

If the space between two adjacent peripheral rings of the same drum is called p, that is to say, the distance separating two groove bottoms (see for example FIG. 2: grooves 440 and 450), an axial spacing equal to one-half pitch, or p/2, as illustrated more particularly in FIG. 1 is chosen preferentially.

This arrangement permits a greater limitation of friction.

Likewise, the axes of rotation cannot be parallel to one another.

Figure 4:
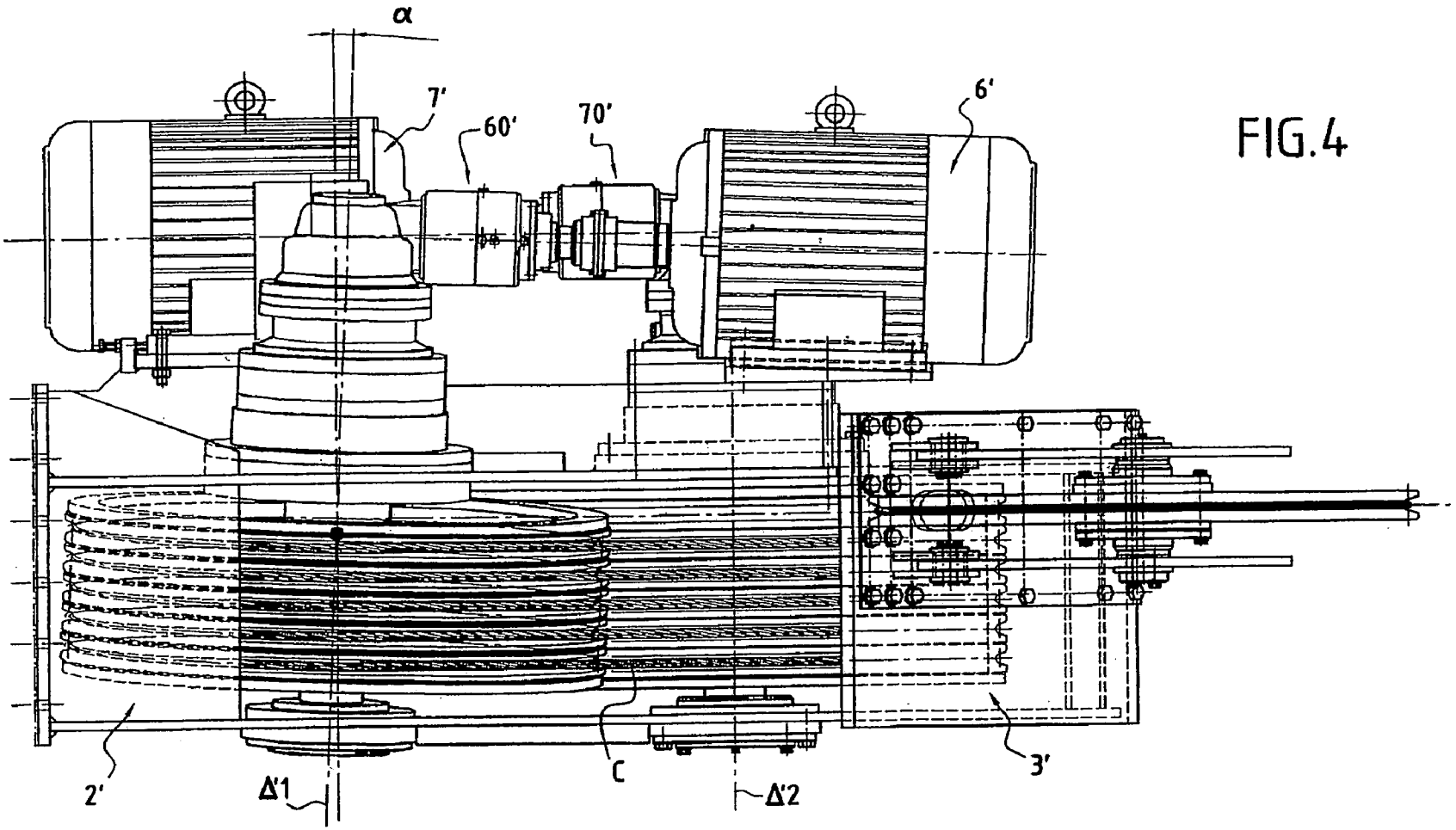
FIG. 4 shows in a side view a second preferred embodiment of the winch according to the invention.

FIG. 4 illustrates, in a side view, a practical embodiment of a winch according to the invention, more precisely a winch according to a second preferred embodiment.

In this figure, only the elements indispensable to good understanding of the invention have been referenced.

According to the essential particularity of this second preferred embodiment, the axes of rotation, here referenced $\Delta'_1$, $\Delta'_2$, associated with the drums, here referenced 2' and 3', form between them an angle $\alpha$ of low amplitude. The drums 2' and 3' are driven by motors here referenced 6' and 7' respectively, via classical means of angular ratio and gears, referenced generally 60' and 70', respectively.

To make it concrete, angle $\alpha$ is typically between 0.5° and 3°.

Angle $\alpha$ is calculated from the pitch p mentioned above (see FIGS. 1 and 2) of the winding diameter of the cable C. Again to make it concrete, in the example illustrated in FIG. 4, the angle $\alpha$ is equal to 2.32°.

This arrangement also permits a greater limitation of the friction.

Furthermore, it is quite compatible, and therefore combinable with the arrangement previously described consisting of performing an axial offset, preferably of a half pitch p/2.

In reading the foregoing it is easy to see that the invention achieves the purposes which it has set for itself.

The winch according to the invention offers numerous advantages, which have been enumerated before.

Without recalling them all, the fact will be stressed that it permits a maximum reduction of the friction of the cable internal combustion engine, the throats of the drums and a correlative limitation of the wear on the cables. For this reason it permits envisaging the use of cables of all types, even expensive ones, prolonging their useful life.

The parts specific to the invention, essentially the peripheral rings, are easy to produce and to machine, and they do not require recourse to particularly expensive materials. They are furthermore easily interchangeable, which permits changing the cable in use without major modifications of the winch.

It should be clear, however, that the invention is not limited to only the embodiments explicitly described, particularly in connection with FIGS. 1 to 4.

Lastly, the numerical examples which were furnished only to make things concrete and they should not constitute any limitation of the scope of the invention. They proceed from a technological choice within the reach of a man of the art.

The invention is not limited, as it has been suggested, to petroleum prospecting alone, or more generally to applications called "off-shore" applications at great depth, even if it finds a particularly important application in these fields.

The invention claimed is:

1. A capstan winch comprising at least two drums arranged opposite one another for pulling a load through a cable wound a predetermined number of times on said drums; wherein each of said drums comprises a peripheral wall and is equipped with a predetermined number of peripheral rings made of elastic material and independent of each other, said peripheral rings strung around said peripheral wall; wherein each of said peripheral rings comprises a peripheral throat to receive said cable and a lower wall in contact with said peripheral wall; and wherein said elastic material constituting said peripheral rings possesses physico-chemical characteristics to simultaneously permit both said cable to be driven and a relative sliding movement between said lower wall of said peripheral rings and said peripheral wall, said relative sliding movement being of an amplitude substantially equal to the longitudinal deformations of said cable, when said cable is subjected to tensions of variable amplitudes.

2. The capstant winch of claim 1, wherein each of said drums is equipped with a pair of lateral rings, wherein at least one lateral ring in each pair is removable, thereby permitting said peripheral rings to be removed or positioned around said peripheral wall.

3. The capstan winch of claim 1, wherein said peripheral rings are made of a synthetic material.

4. The capstan winch of claim 1, wherein said peripheral walls are made of stainless steel or ceramic coated steel.

5. The capstan winch of claim 1, wherein each of said drums revolves about an axis of rotation; wherein the distance between said throats of two adjacent peripheral rings of a drum is defined by a pitch (p) and said drums are spaced apart axially from each other by a fraction of said pitch (p).

6. The capstan winch of claim 5, wherein said fraction is equal to one half-pitch (p/2).

7. The capstan winch of claim 1, wherein each of said drums turns on an axis of rotation and said axes of rotation form an angle ($\alpha$) greater than zero therebetween.

8. The capstan winch of claim 7, wherein said angle ($\alpha$) is between 0.5° and 3°.

9. The capstan winch of claim 1 for use in petroleum exploration in deep waters.

* * * * *